United States Patent [19]

Jefferies et al.

[11] 4,215,643

[45] Aug. 5, 1980

[54] QUICK RELEASE BOLLARD

[75] Inventors: Robert K. Jefferies; Gary L. Egbert, both of Houston, Tex.

[73] Assignee: NL Industries, Inc., New York, N.Y.

[21] Appl. No.: 914,183

[22] Filed: Jun. 12, 1978

[51] Int. Cl.[2] ..... B63B 21/06

[52] U.S. Cl. ..... 114/218; 24/130; 254/376

[58] Field of Search ..... 24/130; 254/150 R; 114/218, 230, 251, 253, 254, 199

[56] References Cited

U.S. PATENT DOCUMENTS

| | | | |
|---|---|---|---|
| 415,965 | 11/1889 | Fletcher | 114/199 |
| 2,677,863 | 5/1954 | John | 114/218 X |
| 3,270,705 | 9/1966 | Roeggen | 254/150 R |
| 3,352,273 | 11/1967 | Herreshoff et al. | 114/218 |
| 3,398,714 | 8/1968 | Wallin et al. | 114/218 |
| 3,580,209 | 5/1971 | Olson | 114/218 |
| 3,730,483 | 5/1973 | Newell | 254/150 R |
| 3,812,811 | 5/1974 | Rodriguez | 114/218 |
| 3,973,511 | 8/1976 | Balston | 114/218 |

*Primary Examiner*—Sherman D. Basinger
*Attorney, Agent, or Firm*—Arnold, White & Durkee

[57] ABSTRACT

A bollard used in vessel mooring and like operations includes a bollard drum around which the line or hawser is wrapped several times to reduce the line tension at the free length behind the drum. A cleat is provided for holding fast the free length of the hawser at the reduced tension. The hawser may be quickly released from the bollard during emergency situations by simultaneously unlatching the cleat and releasing a lock on the bollard allowing it to rotate as the hawser is pulled off and finally lifted out of the cleat.

13 Claims, 5 Drawing Figures

QUICK RELEASE BOLLARD

BACKGROUND OF THE INVENTION

1. Field of the Invention

The present invention relates primarily to the mooring of vessels, for example, ships, barges, work boats, and the like. In particular, the invention relates to a quick release bollard for handling high strength, synthetic or fiber mooring lines without damaging the line.

2. Description of the Prior Art

In barge and ship mooring and like operations, particularly in connection with maneuvering, tying up and casting off in very heavy seas, it is difficult to secure a line to a vessel, and it is even more difficult to afford a quick release of the line when it is desired to free the vessel from restraint. In some instances, in order to avoid great danger, it is necessary to effectuate an extremely quick release. This sometimes has been accomplished by severing the hawser or line, for example, by an axe, but this is not only wasteful and destructive of the cordage but is accomplished by considerable danger to personnel.

The conventional bollard used in mooring operations has taken the form of a rigid post member secured to the deck of a vessel or pier. Such a bollard is typically used in conjunction with a line which terminates in an eye that fits over the post member to effect the connection. This conventional configuration results in several disadvantages, including, for example, a rapid wearing of the eye portion of the line. Furthermore, the only quick release is by a cutting device such as an axe.

An improvement over the conventional post-type bollard is represented by a pivoting mooring hook over which the eye of the line is secured. The operator may pivot the hook from a first holding position to a second release position. Although the pivoting hook does provide means for quickly releasing the line, the line is not released in a controlled manner and, therefore, presents a danger to the crew and equipment. The pivoting hook also has the disadvantage of rapidly wearing the line, especially at the eye. A typical pivoting hook is manufactured by Machinefabriek Manpaey Marine Engineering B.V. in 1313 C.S. Dordrecht, Holland, part # MHX 150401002.

An improvement over the time-honored mooring techniques described above is disclosed in U.S. Pat. No. 3,973,511 to John C. Balston. The bollard described in this patent includes a fixed base mounting a pivotable bollard drum. The mooring line passes around the drum and the adjacent side walls of a channel. Quick release of the line is accomplished by pivoting the bollard whereby the line slips off the top of the bollard and out of engagement with the clamping jaw. It has been found that the Balston bollard, although relatively reliable, is quite bulky and expensive to manufacture due to its complexity. Furthermore, the large number of moving parts which are subjected to the enormous line tensions results in numerous failures. It also requires attaching the mooring line in an unconventional manner requiring extensive training of personnel to be able to quickly secure the rope around the bollard.

Thus, it can be seen that there is an acute need for a simple, safe and reliable bollard which causes minimal line wear and provides a safe quick release in emergency and routine situations.

SUMMARY OF THE INVENTION

In accordance with the instant invention, there is provided a device for holding fast the hawser or line used in a mooring operation. Specifically, the instant invention provides a quick release bollard which may be mounted on a dock, pier, vessel deck or the like, and which provides safe quick release in emergency situations or during routine operations without damaging the hawser.

The instant invention also provides a novel method of mooring wherein the hawser is first inserted into a cleat assembly for holding the free length of the hawser and then wrapped around a bollard drum. The bollard drum assembly, when locked to prevent rotation, receives several wraps of the hawser to reduce the tension in the hawser at the free length so that the tension at the free length being held by the cleat is greatly reduced compared to the working load in the line. As used herein the term "free length" refers to that portion of the line or hawser that is at a reduced tension due to the wrapping of the hawser around the bollard drum. It will be understood that in accordance with the invention a portion of the free length is restrained against longitudinal movement by means of a cleat or the like.

Various mooring operations require the securement of the hawser to a bollard, for example where the bollard is mounted on a dock or pier for typing up a vessel or where the bollard is mounted on an offshore supply boat for the purpose of mooring to an offshore rig. Numerous problems are associated with releasing the hawser under emergency situations. Furthermore, the hawser is often frayed or damaged beyond repair during repeated uses of certain bollard assemblies, therefore requiring the damaged portion to be removed and a new eye formed.

In accordance with this invention, there is provided a bollard for securing a hawser during mooring operations which comprises a bollard comprising a support base adapted for securement to a dock, pier, vessel deck or the like, a bollard drum assembly including a central shaft fixedly secured to and upstanding from said support base, a drum mounted for rotation on said shaft, said drum having a relatively smooth exterior cylindrical surface for receiving a selected number of windings of a line under high tension to reduce the tension at the free length of such line to a fraction of the tension ahead of said drum, a releasable lock assembly for selectively locking said drum against rotation relative to said shaft, and means for restraining motion of the free length of the line at such fractional tension.

Specifically, the bollard of the instant invention comprises a bollard drum assembly having a cylindrical drum mounted on a bearing for rotation relative to a vertical support shaft. A releasable disc-detent locking assembly is provided for locking the drum relative to the shaft or, in the alternative, releasing the drum for relative rotation. The bollard drum assembly is mounted on a support plate which may be secured to the dock, pier, vessel deck, or the like. In a particular embodiment, a cleat assembly having a straight cleat is also mounted on the support plate. The cleat assembly includes a straight cleat having a jaw housing with a V-shaped opening. The opening includes removable jaw halves having slanted teeth for engaging the hawser and restraining it from longitudinal movement. The jaw housing is pivotally mounted on the support plate and is normally restrained against pivotal movement by means of a pair of rollers riding on the housing. A trip lever is provided to move the rollers out of engagement with the housing so that the cleat may move to a released mode wherein the hawser is released from the jaw housing.

In an alternative embodiment, a curved cleat is integrally secured to the external surface of the bollard drum, thereby eliminating the necessity of a separate cleat assembly mounted on the support plate. The curved cleat receives the free length of the hawser and restrains it against longitudinal motion after several wraps have been made around the bollard drum.

In accordance with the instant invention, there is also provided a novel method for holding fast the end of a hawser during mooring operations and quickly releasing the hawser especially in emergency situations. In accordance with this method, a bollard drum is provided that is selectively locked against rotation or unlocked for rotation about its longitudinal axis. The bollard drum is secured to a pier, dock, vessel deck or the like. An intermediate portion of a mooring line is wrapped around the external surface of the bollard drum in a selected number of windings to reduce the tension at the free length of the line to a fraction of the tension in the line ahead of the bollard drum. The drum is locked before placing a portion of the free length of the line in a device suited for restraining longitudinal motion of the free length of the line at such fractional tension.

DESCRIPTION OF THE PREFERRED EMBODIMENT

Figure 1:
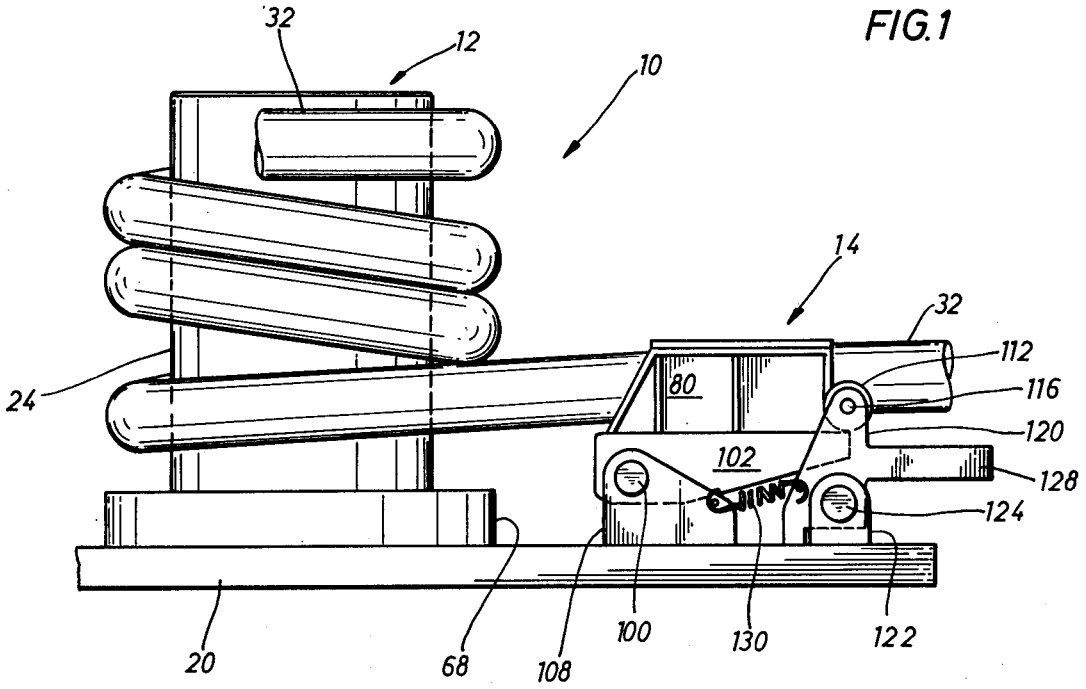
FIG. 1 is a side view of a bollard constructed in accordance with the present invention.
Figure 3:
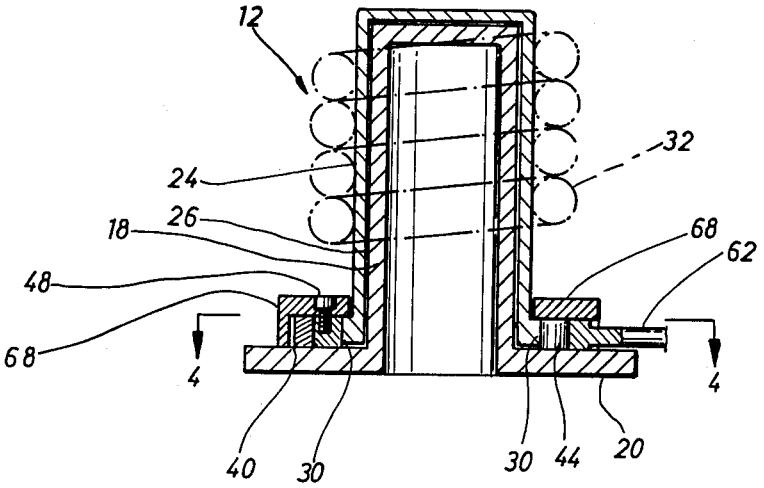
FIG. 3 is a vertical section view of the bollard drum assembly illustrating the operative elements of the lock assembly.

Referring to the drawings, and in particular to FIGS. 1 and 3, there is shown a bollard 10 comprising a bollard drum assembly 12 and a cleat assembly 14. Bollard drum assembly 12 includes an upstanding cylindrical shaft 18 which, in the preferred embodiment is formed integral with a support plate 20, although it may be secured to the support plate by welding or other suitable means. As best shown in FIG. 1, support plate 20 is a common support surface for both bollard drum assembly 12 and cleat assembly 14. Plate 20 is adapted for securement to a dock, pier, vessel deck, or the like by bolting or other suitable means.

A cylindrical bollard drum 24 is slidably received over shaft 18 and is adapted for rotation on a bearing 26. Bearing 26 may take the form of a nylon or other sliding element type bearing or, in the alternative, may take the form of a rolling element type bearing. Drum 24 terminates at its lower end in an integral flange 30 which forms a portion of the bollard lock assembly more fully described below. It will be appreciated that drum 24 provides a relatively smooth cylindrical external surface for receiving the desired number of windings of a line or hawser 32 for reducing the tension in the hawser from a relatively high tension ahead of the bollard to a relative low tension that may be handled by the cleat assembly 14.

Figure 4:
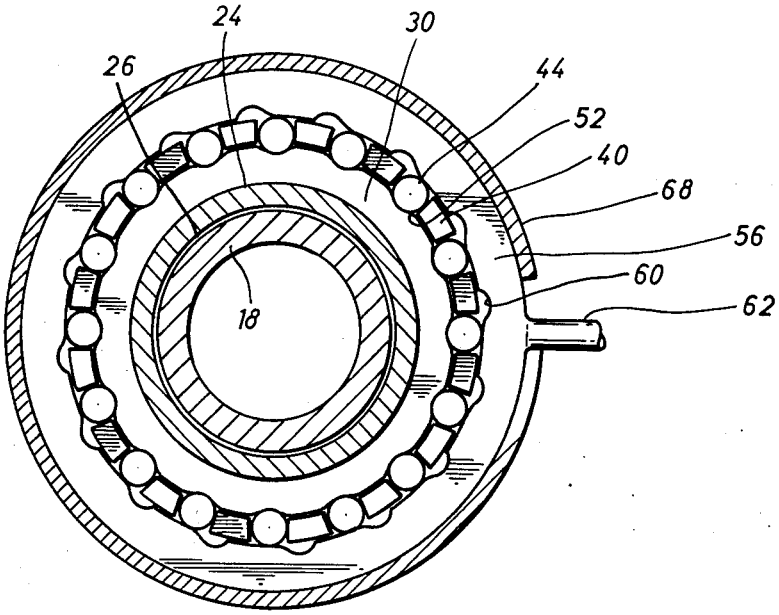
FIG. 4 is a horizontal section view of the bollard drum assembly taken substantially along line 4—4 of FIG. 3 with the lock housing and connecting bolts removed to facilitate illustration.

The lock assembly for bollard drum 24 will now be described in detail with reference to FIGS. 3 and 4. The lock assembly is provided for restraining relative rotational movement between shaft 18 and drum 24 during periods when the hawser is being held fast by the cleat. For release of the hawser, the lock assembly is unlocked so as to allow relative rotation while simultaneously unlatching the cleat to allow the hawser to be quickly removed from the cleat assembly and the bollard drum assembly. While it will be appreciated that other lock configurations may be utilized without departing from the scope of the present invention, the illustrated lock assembly is a disc-detent arrangement which serves to lock the drum flange 30 to the base plate 20.

The lock assembly includes a spacer ring 40 having sixteen openings, each housing a free or floating flat roller disc 44 serving as a lock operating member. Spacer ring 40 is fixedly secured to base plate 20 by any suitable means, for example, by bolts (not shown). It will be appreciated that each opening supports its respective disc 44 from each side and allows radial movement of the disc. Spacer ring 40 is positioned in close relationship with the drum flange 30. Drum flange 30 includes sixteen detents 52 which are adapted to receive the discs 44 when the lock assembly is in its locked or engaged position illustrated in FIG. 4. The lock assembly also includes a detent ring 56 which is held in close sliding relationship to the external surface of spacer ring 40. Detent ring 56 includes sixteen equally spaced detents 60 which are adapted to receive discs 44 for placing the lock assembly in an unlocked or disengaged position which allows the drum 24 to rotate relative to shaft 18. The detent ring includes a lock release lever 62 for rotating detent ring 56 about fixed spacer ring 40. The entire lock assembly is enclosed by a lock housing 68. The lock operating members or discs 44 have a width wider than the width of the spacer ring openings so that at least a portion of the lock operating members or discs 44 must protrude into either the flange detents 52 or the detent ring detents 60, whereby said bollard drum may be locked against rotation relative to said shaft by forcing said operating members into the flange detents 52 and the bollard drum may be unlocked by moving the operating members into the detent ring detents 60. Thus, it can be seen that selected movement of lock release lever 62 will place bollard drum 24 in either a lock position for holding the hawser or an unlocked position for release of the hawser.

Figure 2:
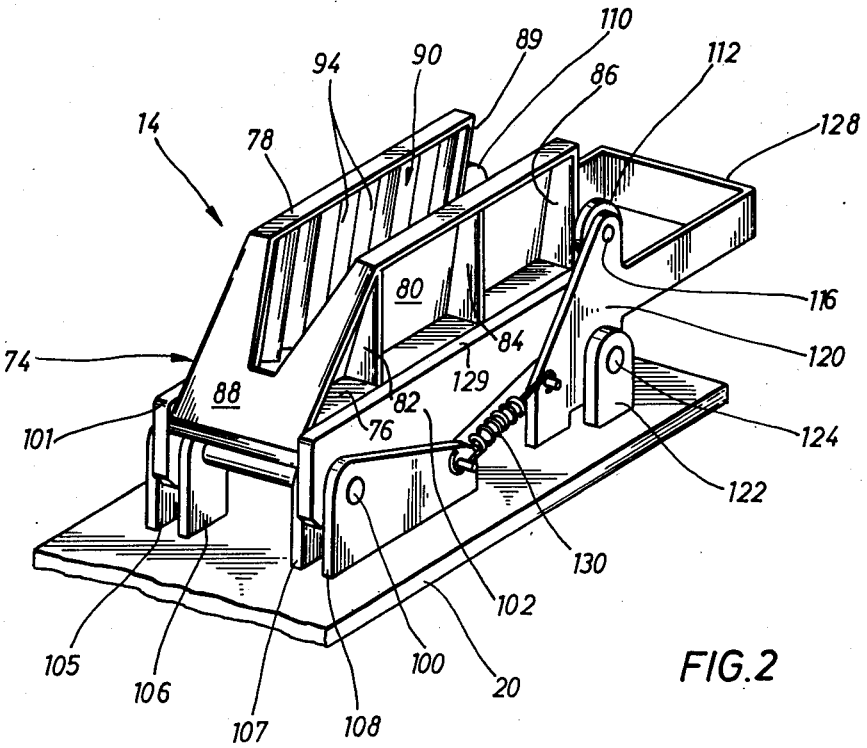
FIG. 2 is a perspective view of the straight cleat assembly illustrated in FIG. 1.

With reference to FIGS. 1 and 2, the description will now turn to a detailed discussion of the cleat assembly 14. As discussed above, cleat assembly 14 is adapted to hold the free length of hawser 32 after it has been wound around the bollard drum assembly several times to reduce by friction the tension at the free end. Cleat assembly 14 is mounted on common base plate 20 separate from but in relatively close proximity to bollard drum assembly 12.

Cleat assembly 14 includes a jaw housing 74 which has a rigid base portion 76 and upstanding converging upper side walls 78, 80 which are strengthened by means of gussets 82, 84, 86. The front wall portion 88 of jaw housing 74 is rearwardly tapering and has a V-shaped cutout for receiving the hawser. The rear wall portion 89 also contains a cutout portion so that the hawser may extend entirely through the jaw housing. Jaw side members 78, 80 are adapted to receive removable jaw halves 90 and 92 (not shown) which are adapted to engage and restrain linear motion of the hawser. The illustrated jaw half 90 includes a number of teeth 94 which are sloped rearwardly at an angle of 45° relative to the jaw housing base 76. The teeth 94 are adapted to engage the exterior surface of the hawser and self locate the hawser downwardly toward base 76 as tension is applied to the hawser. Teeth 94 grip the hawser in the manner well-known in the art to prevent longitudinal movement.

Jaw housing 74 is mounted for pivotal movement about a pivot shaft 100 to facilitate removal of the hawser from the jaw housing during release operations. As best shown in FIG. 2, housing 74 is mounted at its forward end by means of pivot shaft 100 which extends through lower side wall portions 101, 102. Pivot shaft 100 is journaled in support members 105, 106, 107, 108. As been illustrated in FIGS. 1 and 2, lower side wall portions 101, 102 terminate at the rear of jaw housing 74 immediately below rollers 110, 112. As explained below, rollers 110, 112 hold jaw housing 74 in the substantially horizontal position shown in solid lines in FIG. 1 and, when moved out of engagement of the upper surfaces of portions 101, 102, allows the jaw housing to pivot forwardly about shaft 100 to the released position (not shown). Rollers 110, 112 are mounted for rotation on shafts 114 (not shown) and 116. The mounting of roller 112 will be described in detail with the understanding that roller 110 is mounted in an identical fashion. Shaft 116 is received within a mating opening in a release dog 120 which is, in turn, pivotally secured to a support member 122 by means of a pivot shaft 124. A trip lever 128 forms a continuation of both release dog 120 and the release dog on the opposite side. A downward movement of the trip lever 128 causes the release dog to pivot rearwardly, or counterclockwise as viewed in FIG. 1, against the bias of a return spring 130. After rotation of the release dogs on the order of 20°, rollers 110, 112 move out of engagement with the upper surface 129 of lower side walls 101, 102 thereby allowing the jaw housing 74 to move to the released position, due to the tension in the hawser, where the hawser is automatically released from teeth 94 in the manner known to those skilled in the art.

In a typical mooring operation with base plate 20 secured to a pier, vessel deck or the like, a portion of the hawser is first placed into the jaw housing for engagement with teeth 94, then wrapped several times around the bollard drum 24 and tension is applied to the hawser. With the detent ring 56 positioned so that the roller discs 44 are protruding into detents 52 of bollard drum flange 30, the bollard is locked in the manner illustrated in FIG. 4. The tension on the hawser behind the drum is reduced greatly by the friction of the hawser against the drum so that the resultant tension at the free end is low enough to be held by cleat assembly 14. For release, even under maximum hawser tension, the trip lever 128 is disengaged thereby allowing the cleat to pivot up. Simultaneously, lock release lever 62 is moved to rotate detent ring 56 until discs 44 fall into detents 60, thereby releasing drum 24 for rotation relative to shaft 18. The hawser then pulls off of the bollard and is lifted out of the cleat assembly 14.

It has been found that most commercial line sizes are in the range from one to seven inches in diameter. Since there is an optimum ratio of bollard drum diameter to line diameter of 4 to 1, the bollard drum assembly preferably is provided in different diameters in order to accommodate the various line sizes.

EXAMPLE

A bollard was designed to handle a 4¼ inch diameter line manufactured by Sampson Ocean Systems Cordage Works of Boston, Massachusetts and having a breaking strength of 504,000 pounds. The bollard is designed to withstand a tension equal to or greater than the breaking strength of the hawser. Since the optimum ratio of bollard drum diameter to line diameter is 4 to 1, the bollard drum diameter was selected as 17 inches. It will be appreciated, however, that a bollard drum having a selected diameter may accommodate more than one line size since the 4 to 1 ratio is a guideline for optimum performance, but does not have to be adhered to rigidly. The bollard drum and shaft are made from seamless steel pipe, ASTM A-106, grade C, which gives a tensile strength on the order of 70,000 pounds per square inch and a yield strength on the order of 40,000 pounds per square inch. The sliding-element bearing between the bollard drum and shaft is formed from plastic. The removable jaw halves 90 secured within jaw housing 74 are configured to accommodate the 4¼ inch line diameter.

ALTERNATIVE EMBODIMENT

Figure 5:
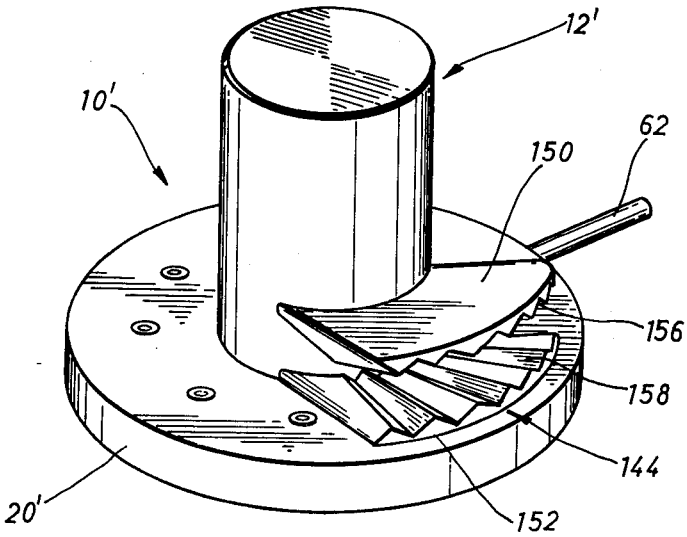
FIG. 5 is a perspective view of an alternative embodiment of the bollard.

FIG. 5 illustrates an alternative embodiment of the bollard of the present invention wherein the cleat assembly is made integral with the bollard drum. Bollard 10' includes a bollard drum assembly 12' which is identical with the previously described drum assembly 12 except that it is mounted on a support plate 20' and includes a curved cleat 144 in lieu of a straight cleat. Cleat 144 is secured to the exterior of the bollard drum instead of the support plate. Cleat 144 comprises upper and lower jaw housings 150 and 152, respectively. Housing 150, 152 preferably are welded to the exterior of the bollard drum, although they may be integrally cast with the drum. Housings 150, 152 mount removable jaw teeth sections 156, 158 which are selected by size to accommodate the diameter of the line being used. While sacrificing some versatility, the jaw teeth may be integrally cast with the jaw housings.

The operation of the alternative embodiment is as follows. Beginning from the bottom, the hawser is inserted in the cleat and the adjacent portion of the hawser is wrapped around the bollard drum. Approximately four wraps are required in most situations. With the bollard drum assembly in the locked or engaged mode, the line tension is allowed to build up thereby causing the line to self locate and become fully restrained within the curved cleat. At the completion of the mooring operation the bollard can be unlocked under full line tension by moving the release lever, thereby allowing the bollard drum to rotate. The line then pulls off the bollard and peels out of the cleat. To prepare the bollard for the next moor, the bollard is manually rotated to the locked position.

The instant invention has been disclosed in connection with specific embodiments. However, it will be apparent to those skilled in the art that variations from the illustrated embodiments may be undertaken without departing from the spirit or scope of the invention.

What is claimed is:

1. A bollard comprising:

a support base adapted for securement to a dock, pier, vessel deck or the like;

a bollard drum assembly including a central shaft fixedly secured to and upstanding from said support base, a drum mounted for rotation on said shaft, said drum having a relatively smooth exterior cylindrical surface for receiving a selected number of windings of a line under high tension to reduce the tension at the free length of such line to a fraction of the tension ahead of said drum;

a releasable lock assembly for selectively locking said drum against rotation relative to said shaft, said lock assembly comprising (i) a flange forming an integral continuation of said bollard drum, said flange including peripheral detents;

(ii) a spacer ring fixedly secured to said support base in close relation to the periphery of said flange, said spacer ring having openings carrying a plurality of free lock operating members;

(iii) a movable detent ring positioned in close sliding relation to the outside surface of said spacer ring, said detent ring having detents at the inner ring surfaces thereof;

(iv) said lock operating members having a width wider than the width of said spacer ring openings so that at least a portion of the operating members must protrude into either said flange detents or said detent ring detents, whereby said bollard drum may be locked against rotation relative to said shaft by forcing said operating members into said flange detents and said bollard drum may be unlocked by moving said operating members into said detent ring detents; and means for restraining motion of the free length of the line at such fractional tension.

2. A bollard as claimed in claim 1 including a bearing upon which said drum is mounted for rotation.

3. A bollard as claimed in claim 1 wherein said lock operating members comprise flat discs.

4. A bollard as claimed in claim 1 wherein said means for restraining comprises a separate cleat assembly mounted on said support base remote from said drum assembly.

5. A bollard as claimed in claim 4 wherein said cleat assembly includes a jaw housing defining a longitudinal V-opening and teeth disposed in said V-opening for gripping the line and restraining the line against longitudinal movement.

6. A bollard as claimed in claim 5 wherein said jaw housing is pivotally mounted at the end facing the bollard drum assembly and includes means for selectively restraining the pivoting of said jaw housing during periods where the line is held fast and for releasing said jaw housing for pivoting to release the line therefrom.

7. A bollard as claimed in claim 6 wherein said means for selectively restraining and releasing comprises at least one roller element mounted to ride on an upper surface of a portion of the jaw housing and a trip lever for moving said roller out of engagement with the jaw housing.

8. A bollard as claimed in claim 1 wherein said means for restraining comprises a curved cleat fixedly secured to the external cylindrical surface of said bollard drum, said curved cleat subtending a selected arc on said drum and having internal teeth for gripping the line and restraining the line from longitudinal movement, whereby an intermediate portion of the line may be wrapped around the bollard drum and the free end may be inserted into the curved cleat.

9. A bollard as claimed in claim 8 wherein the subtended arc is on the order of 90°.

10. A bollard comprising:

a support base adapted for securement to a dock, pier, vessel deck or the like;

a bollard drum assembly including a central shaft fixedly secured to and upstanding from said support base, a drum mounted for rotation on said shaft, said drum having a relatively smooth exterior cylindrical surface for receiving a selected number of windings of a line under high tension to reduce the tension at the free length of such line to a fraction of the tension ahead of said drum;

a releasable lock assembly for selectively locking said drum against rotation relative to said shaft; and means for restraining motion of the free length of the line at such fractional tension, said means for restraining motion comprising (i) a separate cleat assembly mounted on said support base remote from said drum assembly, said cleat assembly including a jaw housing defining a longitudinal V-opening and teeth disposed in said V-opening for gripping the line and restraining the line against longitudinal movement;

(ii) said jaw housing being pivotally mounted at the end facing the bollard drum assembly and including means for selective restraining the pivoting of said jaw housing during periods when the line is held fast and for releasing said jaw housing for pivoting to release the line therefrom; and (iii) at least one roller element mounted to ride on an upper surface of a portion of the jaw housing and a trip lever for moving said roller out of engagement with the jaw housing.

11. A bollard for restraining a mooring line comprising an upstanding cylindrical shaft adapted for fixed securement to a dock, pier, vessel deck or the like, a bearing on said shaft, a cylindrical drum mounted on said bearing for rotation relative to said shaft, said drum terminating at its lower end in a circular flange having at least one detent on its periphery, a spacer ring fixedly secured relative to the shaft and in closed proximity to the flange periphery, said spacer ring having at least one radial opening carrying a free lock operating member, a rotatable detent ring mounted in close sliding proximity to the periphery of said spacer ring and including at least one internal detent adapted for receiving said lock operating member and a straight cleat spaced from said drum and having internal teeth sized and disposed at an angular attitude for restraining the free length of the line during mooring operations.

12. A bollard for restraining a mooring line comprising an upstanding cylindrical shaft adapted for fixed securement to a dock, pier, vessel deck or the like, a bearing on said shaft, a cylindrical drum mounted on said bearing for rotation relative to said shaft, said drum terminating at its lower end in a circular flange having at least one detent on its periphery, a spacer ring fixedly secured relative to the shaft and in close proximity to the flange periphery, said spacer ring having at least one radial opening carrying a free lock operating member, a rotatable detent ring mounted in close sliding proximity to the periphery of said spacer ring and including at least one internal detent adapted for receiving said lock operating member and a curved cleat fixedly secured to the external surface of said cylindrical drum, said curved cleat subtending an arc on said drum and having internal teeth sized and disposed at an angular attitude for restraining the free length of the line during mooring operations.

13. A bollard as claimed in claim 12 wherein said arc is on the order of 90°.

* * * * *